United States Patent [19]

Skogward

[11] Patent Number: 4,513,678

[45] Date of Patent: Apr. 30, 1985

[54] CLOTH FEEDER

[75] Inventor: Kenneth O. E. Skogward, Huskvarna, Sweden

[73] Assignee: Husqvarna Aktiebolag, Huskvarna, Sweden

[21] Appl. No.: 514,818

[22] PCT Filed: Nov. 8, 1982

[86] PCT No.: PCT/SE82/00375

§ 371 Date: Jun. 24, 1983

§ 102(e) Date: Jun. 24, 1983

[87] PCT Pub. No.: WO83/01796

PCT Pub. Date: May 26, 1983

[30] Foreign Application Priority Data

Nov. 11, 1981 [SE] Sweden ..... 8106700

[51] Int. Cl.[3] ..... F23M 9/00

[52] U.S. Cl. ..... 112/323; 112/324

[58] Field of Search ..... 112/323, 324, 312, 303

[56] References Cited

U.S. PATENT DOCUMENTS

| | | | |
|---|---|---|---|
| 2,427,467 | 9/1947 | Loiselle | 112/324 |
| 2,522,587 | 9/1950 | Stalder | 112/323 |
| 3,358,630 | 12/1967 | Maddi et al. | 112/324 |
| 3,922,980 | 12/1975 | Fulp | 112/324 |
| 4,159,003 | 6/1979 | Johnson et al. | 112/324 X |

*Primary Examiner*—Ronald Feldbaum

*Attorney, Agent, or Firm*—Alfred E. Miller

[57] ABSTRACT

The cloth feeder of a sewing machine is formed of an elongated plate having rows of teeth extending parallel to the direction of feeding movement of the cloth feeder. The cloth feeder and stitcher plate have slot-and-pin guides arranged to guide the feeder for movement in the feeding direction.

5 Claims, 4 Drawing Figures

CLOTH FEEDER

The present invention is related to a cloth feeder in a sewing machine having a feeding movement in the shape of a rectangle.

The cloth feeder requires an accurate adjustment in order to work satisfactorily. One of these adjustments is related to the centering of the rows of teeth of the feeder in the elongated slots in the stitch plate in which these rows protrude during the feeding movement. The stitch plate must also be secured to a working surface of the base portion of the sewing machine in order to make the adjustment durable. As the feeder was hitherto usually made of metal it is especially important that the mechanism is free from play and that no metal parts hit against each other which would make it noisy. As a complement to the adjustment of the mechanism to freedom from play one can introduce plastic bearings which work very silently. A feeder having bearings of plastics against the stitch plate is easy to manufacture and to adjust and needs very little room in the sewing machine body.

The purpose of the present invention is double-first it has an arrangement for guiding the feeder directly in the stitch plate and then the feeder has moulded plastic attachments which i.a. simplify the manufacturing and adjustments. The arrangement for guiding the feeder is simply made in the shape of pins and slots by which the feeder is fixed laterally, perpendicularly to the feeding direction. The pins and the slots are so positioned that the rows of teeth are centered in the slots made for the feeder in the stitch plate. The feeder is constituted of a plate provided with moulded plastic attachments, such as feeding teeth, slide bearings, lifting knob etc. A feeder like this makes a saving of a plurality of details which are necessary in conventional designs and becomes then cheaper than conventional designs.

Figure 2:
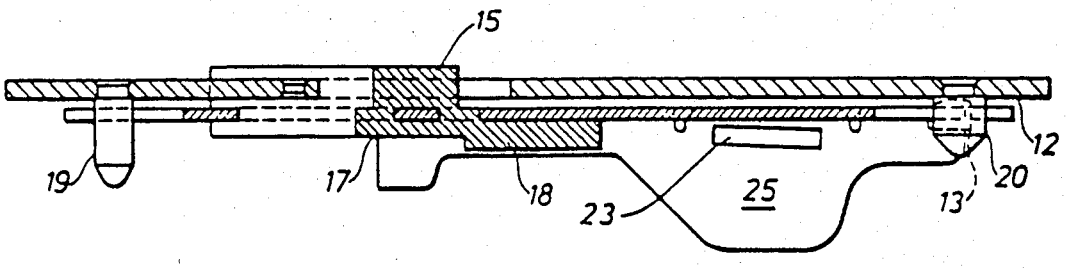
Figure 1:
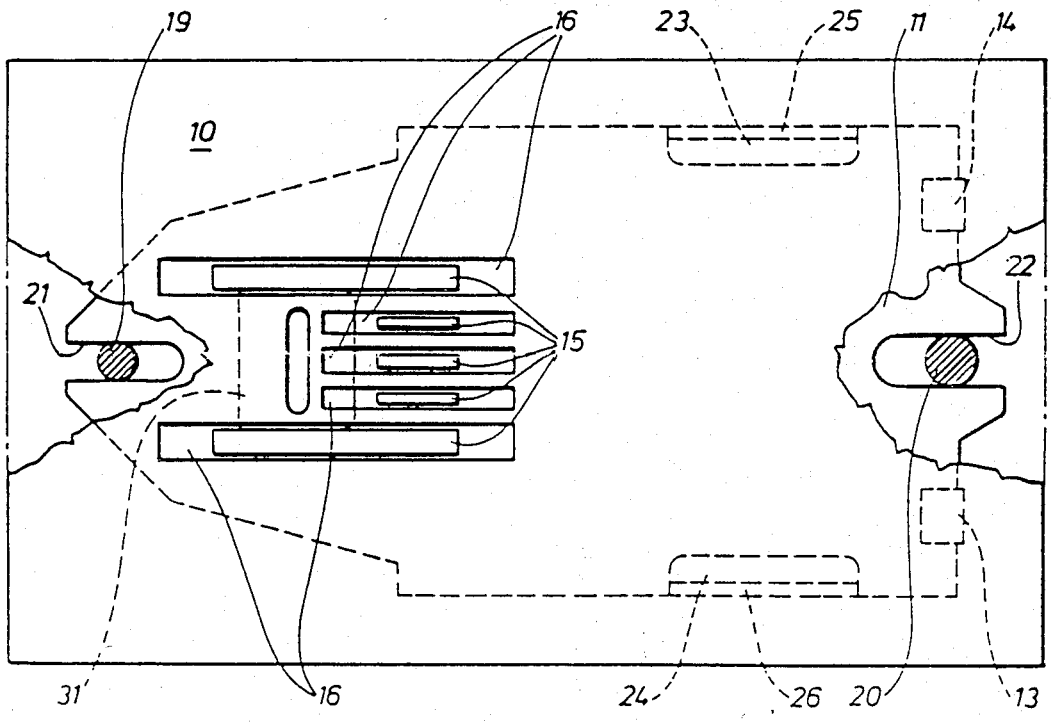
Figure 4:
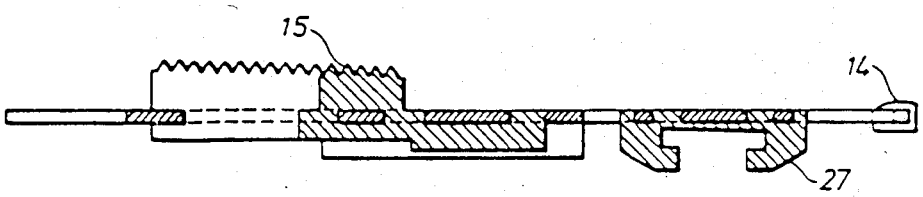
Figure 3:
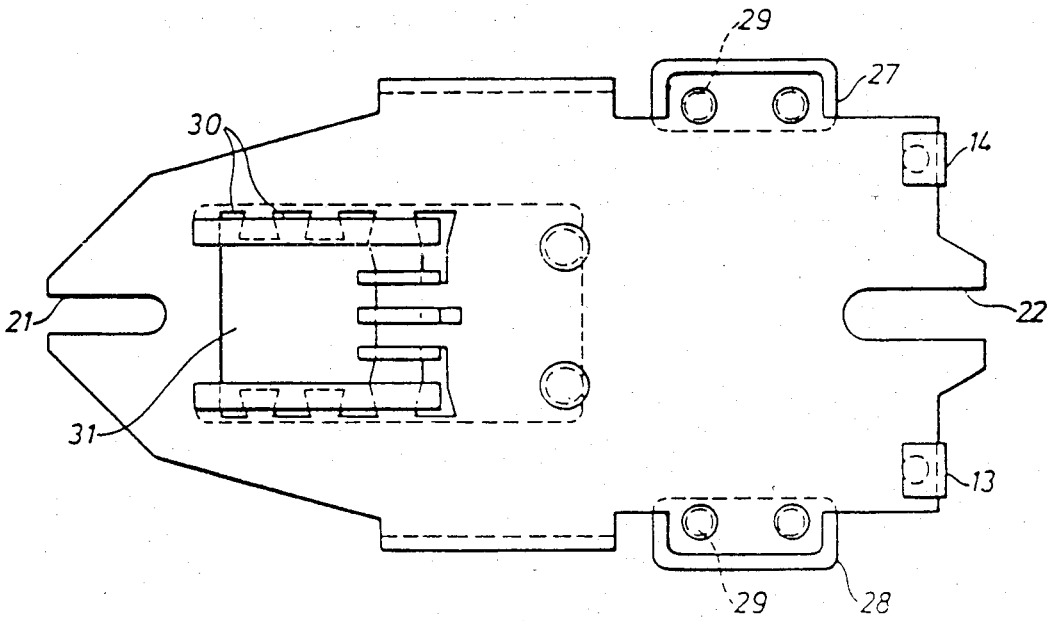

An embodiment of a cloth feeder according to the invention is described by way of example in the following with reference to the accompanying drawing which shows in FIG. 1 a horizontal projection of a stitch plate and a feeder, FIG. 2 a vertical cross section through the same, FIG. 3 a horizontal projection of a feeder, and FIG. 4 a vertical cross section thereof.

The stitch plate 10 is of a rectangular form and fits in a conformable rectangular recess in the working surface on the base portion of the sewing machine. The plate can be removed from the recess and then the feeder plate 11 becomes visible. The stitch plate and the feeder plate are usually separated by an interspacing 12 which is about the height of a couple of slide bodies 13, 14 of plastics at the rear end of the feeder plate. The operating part of the feeder is formed by feeding teeth 15 which protrude in the slots 16 in the stitch plate. These teeth are formed by a plastic body 17 moulded on the feeder plate and, on the underside thereof, forming a lifting knob 18 which normally rests on a level control member of the feeding mechanism (not shown). The rows of teeth 15 are well centered in the slots 16 in order to avoid friction against the stitch plate. The mutual positions of the plates are achieved by means of the guidance of the slots and pins, of which the pins 19, 20 are located on the underside of the stitch plate and the slots 21, 22 in each end of the feeder plate. The pin 19 is so long that it enters a hole (not shown) in the working surface and thus prevents the plate from being unintentionally lifted. The slots guide the feeder during the horizontal feeding movement carried out in the longitudinal direction of the rows of teeth. The feeding movement is transferred from the feeding mechanism via a slide (not shown) which is inserted in a couple of bearings 23, 24 which are either constituted of angle pieces 25, 26 of the feeder plate (FIGS. 1, 2) or of plastic bodies 27, 28 moulded on the plate (FIGS. 3, 4). All plastic details are well secured to the feeder plate which is prepared for the moulding by the presence of holes 29 and slits 30 at the locations of the plate where the moulding shall take place. The melted plastic mass penetrates these holes and slits and fastens the plastic body at the respective location. Between the rows of teeth there is a bigger hole 31 in the feeder plate, where the needle shall pass through the plate to the underlying hook mechanism.

The embodiment now described is an example of how the invention can be realized. The guidance of the feeder plate in the stitch plate can be carried out by several means other than those here described. The fact that the feeder in this example is a plate does, of course, not exclude other embodiments of the same.

I claim:

1. In a cloth feeder in a sewing machine positioned below a stitch plate located in the working surface of a sewing machine, the plate having slots for the rows of teeth of the feeder, the improvement wherein, guiding means are cooperatively arranged on the stitch plate and on the feeder respectively, to guide the centre longitudinal line of each row of teeth along the centre line of the corresponding slot during a feeding movement of the feeder.

2. A cloth feeder according to claim 1, wherein the guiding means on the feeder include plastic bodies which slide on the underside of the stitch plate during the feeding movement.

3. A cloth feeder according to claim 2, wherein one of the plastic bodies includes said rows of teeth.

4. A cloth feeder according to claim 1, wherein the guiding means include at least a slot-and-pin guidance, having a slot located in the feeder and a pin located in the stitch plate.

5. A cloth feeder according to claim 4, wherein the body of the feeder is comprised of an elongated plate provided in its ends with said slot-and-pin guidances.

* * * * *